US005820940A

United States Patent [19]

Gorynin et al.

[11] Patent Number: 5,820,940

[45] Date of Patent: Oct. 13, 1998

[54] PREPARATION OF ADHESIVE COATINGS FROM THERMALLY REACTIVE BINARY AND MULTICOMPONENT POWDERS

[75] Inventors: Igor Vasilievich Gorynin; Boris Vladimirovich Farmakovsky; Alexander Pavlovich Khinsky; Karina Vasilievna Kalogina, all of St. Petersburg, Russian Federation; Alfredo Riviere V., Caracas, Venezuela; Julian Szekely, Weston; Navtej Singh Saluja, Arlington, both of Mass.

[73] Assignee: Technalum Research, Inc., Cambridge, Mass.

[21] Appl. No.: 80,648

[22] Filed: Jun. 21, 1993

(Under 37 CFR 1.47)

Related U.S. Application Data

[63] Continuation of Ser. No. 993,014, Dec. 18, 1992, abandoned, which is a continuation of Ser. No. 902,699, Jun. 23, 1992, abandoned, which is a continuation-in-part of Ser. No. 755,294, Sep. 5, 1991, abandoned.

[51] Int. Cl.[6] ..... B05D 3/12

[52] U.S. Cl. ..... 427/455; 427/191; 427/192; 427/456

[58] Field of Search ..... 427/455, 456, 427/191, 192

[56] References Cited

U.S. PATENT DOCUMENTS

| | | | |
|---|---|---|---|
| 5,268,045 | 12/1993 | Clare | 427/456 X |
| 5,312,648 | 5/1994 | Gorynin et al. | 427/192 |
| 5,362,523 | 11/1994 | Gorynin et al. | 427/456 X |

*Primary Examiner*—Michael Lusignan
*Attorney, Agent, or Firm*—Choate, Hall & Stewart

[57] ABSTRACT

The method of preparing an adhesive layer on a substrate includes introducing a thermally reactive powder comprising aluminum and a second metal into a plasma torch, wherein the thermally reactive powder is substantially free of binder, additive and contaminant and does not contain a significant amount of intermetallic compound into a plasma torch. An exothermic reaction is initiated within the thermally reactive powders in the plasma torch and the exotherming powders impinge onto a substrate, such that the heat generated by the exothermic reaction is generated predominantly on the substrate.

28 Claims, 1 Drawing Sheet

PREPARATION OF ADHESIVE COATINGS FROM THERMALLY REACTIVE BINARY AND MULTICOMPONENT POWDERS

This is a continuation of application Ser. No. 07/993,014 filed on Dec. 18, 1992, now abandoned, which is a continuation of now abandoned U.S. Ser. No. 07/902,699, filed Jun. 23, 1992, which is a continuation-in-part of now abandoned U.S. Ser. No. 07/755,294, filed Sep. 5, 1991.

FIELD OF THE INVENTION

The present invention relates to a method for preparing films with superior adhesion properties. The invention further relates to the plasma spraying of thermally reactive composite aluminum powders. The preparation of such thermally reactive powders is described in a co-pending U.S. patent application Ser. No. 07/775,127 filed Sep. 5, 1991.

BACKGROUND OF THE INVENTION

Improved adhesion of a coated layer onto the substrate surface is desirable to prevent spalling of the coating from the substrate and enhance adhesion of subsequent layers. Formation of a diffusion layer at the interface of the substrate and coating has been used to create a strong bond between the two layers. However, formation of such a diffusion layer requires a substantial amount of heat which is often not practical. Thermally reactive powders are often used to provide the high local heating required for diffusion bonding. Thermally reactive powders are defined as powders that react exothermically and whose reaction, once initiated, is self-propagating. Such powders have been shown to bond reasonably well to smooth surfaces.

A standard method of preparing a substrate coating involves the flame spraying of a thermally reactive powder. One problem associated with this method is the preparation of a thermally reactive powder having a predetermined chemical composition and structure. Using a simple mixture of single component powders has been shown ineffective because the exothermic reaction does not proceed to completion, a necessary condition for good bonding to occur.

U.S. Pat. Nos. 3,338,688 and 3,436,248 disclose a method of preparing an aluminum-clad metal particle for use in the flame spraying of thermally reactive powders. Methods of producing the aluminum-clad powder according to these patents include depositing a metal from solution by reduction on a seed or nucleus, vapor deposition, thermal decomposition of metal carbonyls, hydrogen reduction of metal halide vapors, thermal deposition of halides, carbonyls, hydrides, carbonyls, organometals, or other volatile compound or, most preferably, coating one compound with another compound in the form of a paint, the paint being a dispersion of a fine metal in a binder or lacquer. In all these approaches, the cladding contains substantial amounts of impurities and/or other materials. These impurities are carried along throughout the spraying process and are co-deposited with the intermetallic coating resulting in a degradation of the coating properties.

Alternatively, the forming of alloys has been proposed as a method of preparing an intimate mixture of metals free of undesirable additives and impurities. U.S. Pat. No. 4,027,367 discloses the spray bonding of nickel-aluminum and nickel-titanium alloys in the form of wires. The direct alloying of reactive metals necessarily results in some reaction of the two metals. This results in the substantial completion of the exothermic reaction prior to the coating step. Less of the necessary heat is therefore available for diffusion bonding on the substrate surface.

Practice of the present invention overcomes the difficulties and disadvantages of the prior art. The method of the present invention provides coatings and subcoatings of high purity with excellent adhesive properties capable of use with a wide variety of substrates and outer coatings.

SUMMARY OF THE INVENTION

It is the object of the present invention to prepare intermetallic aluminum coatings with superior adhesive properties and resistance to thermal shock.

It is a further object of the present invention to prepare a substrate coating with optimal adhesive properties by maximizing the exotherm and hence, the diffusion bonding, on the substrate surface.

In a preferred embodiment of the present invention, a thermally reactive powder containing aluminum and a second metal, chosen because it reacts exothermically with aluminum, is introduced into a plasma torch. The powder is substantially free of binders, additives or contaminants. "Additives and contaminants", as that term is used herein, means any compound or material that does not contribute to the exothermic reaction nor provide other desirable properties to the resultant adhesive layer such as ductility or surface toughness. Additionally, the thermally reactive powder does not contain a significant amount of intermetallic compound, i.e., it has not been prereacted to a substantial extent. The term "intermetallic compound", as that term is used herein, is a compound of two or more metals in definite stoichiometric proportions. The heat of the plasma torch initiates an exothermic reaction within the thermally reactive powders thereby forming an intermetallic compound. A coating is formed by impinging the exotherming powders onto a substrate and the reaction is completed on the surface of the substrate. The heat generated by the reaction causes diffusion of the adhesive layer materials into the substrate, thereby forming a diffusion layer and a strong bond between the adhesive coating and the substrate. The adhesive layer is typically 1–100 $\mu$m thick. To optimize adhesion, it is desirable that the exothermic reaction occur substantially on the substrate.

In preferred embodiments, the starting thermally reactive powder is an aluminum-coated metal powder. The metal can be mechanically coated with aluminum. By "mechanically coated", as that term is used herein, it is meant that there is a distinct interface between the aluminum coating and metal core and that no intermetallic compound is formed. Alternately, the metal can be chemically bonded with aluminum. By "chemically bonded", as that term is used herein, it is meant that an intermetallic compound is formed at the narrow interface between the aluminum coating and the metal core. The aluminum coating is substantially free from binder and impurities. Suitable powders have been prepared according to the method described in a co-pending U.S. patent application Ser. No. 07/775,127. The thermally reactive powder can also be prepared by mechanical alloying of aluminum and the second metal. The second metal itself can be an alloy of two or more metals.

In a preferred embodiment of the invention, the process is carried out in a protective atmosphere, such as argon or nitrogen. The protective atmosphere contains preferably less than 0.001% oxygen to avoid adventitious oxidation. In another preferred embodiment, the process is carried out in air. Under these conditions, oxides of the second metal and aluminum are also formed.

In preferred embodiments, the composition of the thermally reactive powder can be varied. For example, an excess of aluminum can be present, such that upon completion of the reaction, unreacted aluminum remains dispersed throughout the layer, thereby imparting ductility and flexibility to the layer. Varying compositions also result in the formation of different intermetallic compounds with different heats of formation. The composition of the thermally reactive powder can be chosen so as to control or maximize the amount of heat generated during the exothermic reaction.

In order to obtain superior adhesion of the applied layer, it is important that the exotherm occurs substantially on the surface of the substrate. This is accomplished by minimizing time-of-flight of the exotherming powders and, in particular, by selecting the position of the substrate with respect to the plasma torch flame and the point of powder introduction within the flame. The substrate can be variably positioned relative to the base of the plasma torch flame. In other preferred embodiments, thermally reactive powder is introduced near the base of the plasma torch flame (hot zone). The thermally reactive powder can also be introduced near a tip of the plasma torch flame (cool zone).

The heat generated by the exothermic reaction improves the diffusion of the coating into the substrate and increases adhesion of the coating to the substrate. The adhesive strength of the layer is generally equivalent to or better than corresponding coatings prepared by thermal spraying of conventional powders or alloys.

DESCRIPTION OF THE PREFERRED EMBODIMENT

The invention relates to a method of preparing coatings having superior adhesion by plasma spraying thermally reactive powder onto a substrate. The thermally reactive powder contains aluminum and a second metal which are free from additives and impurities that degrade the adhesive quality of the deposited coating. Aluminum and the second metal are capable of reacting exothermically to form an intermetallic compound. The heat generated locally at the substrate-coating interface promotes diffusion of the intermetallic compound into the substrate resulting in a coating strongly bonded to the substrate. The thermally reactive powder is preferably an aluminum-coated metal powder.

Figure 1:
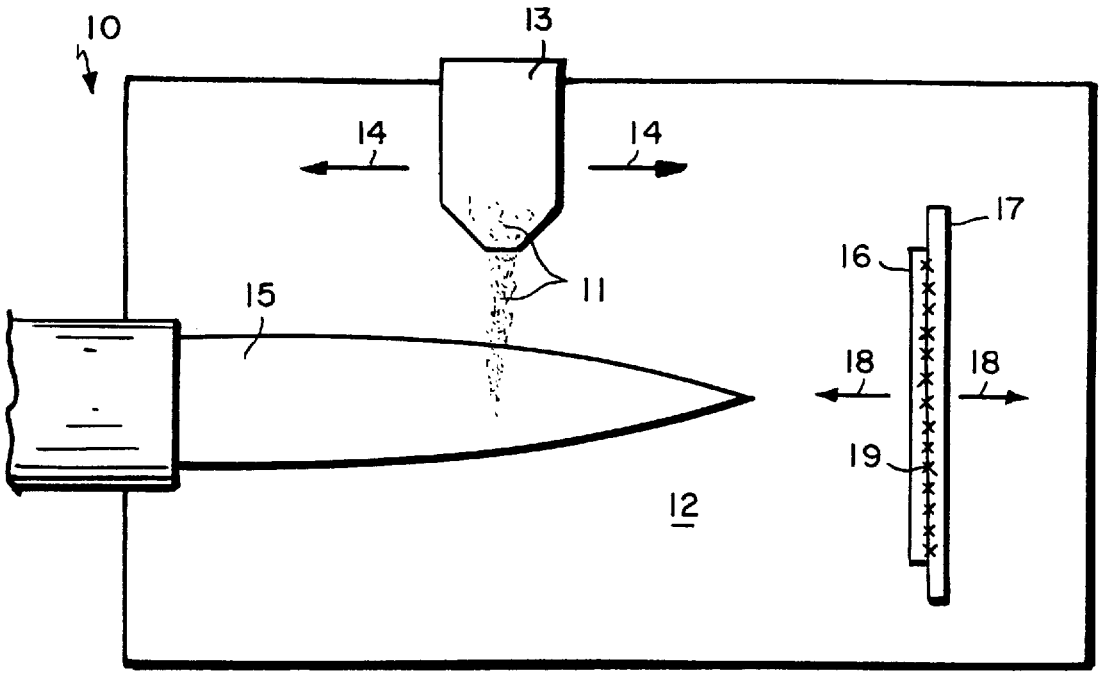
FIG. 1 is a cross-sectional view of the apparatus in one embodiment of the invention used to deposit the adhesive layer.

The method of the present invention adjusts the processing parameters to allow the exotherm of the reacting powders to occur predominantly on the substrate. FIG. 1 illustrates an apparatus 10 used in the deposition of an adhesive layer having superior adhesive properties. A thermally reactive powder 11 is introduced into a deposition chamber 12 from a variably positioned feeder 13. The feeder 13 is capable of movement along the length of the flame in the directions indicated by arrows 14. Means of controlling the atmosphere within the chamber is provided (not shown). The powder 11 is directed into a plasma torch flame 15 and deposited as a layer 16 onto a substrate 17. The heat of the plasma torch flame 15 initiates an exothermic reaction in the powder 11. The substrate is capable of movement in the directions indicated by arrows 18 to alter the time-of-flight of the exotherming powders. Upon deposition of the exotherming powders onto the substrate 17, the reaction continues to generate heat. The heat generated in such close proximity to the substrate/coating interface promotes diffusion across the interface. If the powders travel a short distance, only a small amount of time elapses between the initiation of the exothermic reaction in the flame and impinging the substrate. Hence, the reaction has not progressed very far and the exothermic reaction occurs primarily at the substrate. In the current embodiment, the substrate is preferably positioned in the range of 50 to 120 mm, more preferably 50 to 70 mm and most preferably 60 mm from the base of the plasma torch flame. Powders are preferably introduced approximately 40 mm from the base of the plasma torch flame. However, it is recognized that different flame configurations may change the preferred distances. A diffusion region 19 is formed at the interface whose formation is promoted by the heat generated during deposition of the layer 16. An overcoat layer can be applied to the adhesive layer 16 in a subsequent process.

The metal used in the above process can be any transition group metal provided that it reacts exothermically with aluminum. It can also be an alloy of two or more transition group metals. The thermally reactive powder is preferably a composite powder prepared from aluminum and one or more of Co, Cr, Mo, Ta, Nb, Ti or Ni. Nickel is a most preferred metal because of the large amount of heat generated upon its reaction with aluminum. Nickel aluminides also exhibit superior oxidation and corrosion resistance. With the rigorous exclusion of oxygen, several intermetallic compounds are possible in the reaction of aluminum and nickel (eq 1), $$Ni+Al \rightarrow NiAl_3+Ni_2Al_3+NiAl+\text{Ni-Al solid solution.} \quad (1)$$

The heat of formation, $\Delta H_f$, and hence the total amount of heat generated, $Q_T$, is different for each compound. $Ni_3Al$ has the greatest heat of formation. When air is used as the plasma chamber atmosphere, nickel and aluminum oxides are also formed. However, less heat is generated in the generation of oxides. Despite the reduced heat generated, this may be desirable when, for example, the overcoat layer is more compatible with an oxide compound than an intermetallic compound.

The degree of adhesion of layer 16 can be optimized in at least two ways. Firstly, the composition and quality of the thermally reactive powders can be selected to provide maximum exotherm upon reaction. Secondly, the processing, conditions can be adjusted to allow maximum exotherm to occur on the substrate surface.

The quality of the thermally reactive powder can be improved by providing an intimate mixture of both metals used in the process in order to maximize the heat generated from the reaction and, thus, maximize diffusion bonding. Intimate mixing can be achieved by coating the soft aluminum onto the core metal to form a coating of aluminum as described in co-pending U.S. application Ser. No. 07/775,127. The smaller the starting size of the core metal, the greater the contact between the two metals. Both the aluminum and core metal are very pure and contain substantially no binder, additive or impurity. It is important to remove impurities from the source powder because they do not contribute to the exothermic reaction and because they may contaminate the substrate surface.

The relative proportion of aluminum and second metal can be varied to obtain different intermetallic compounds and hence, different $Q_T$. For example, when the substrate is thermally stable such as a metal, then a metal to aluminum ratio is chosen so as to maximize the formation of $Ni_3Al$ and maximize $Q_T$ to increase diffusion across the interface. In some applications, the substrate melts at a relatively low temperature, for example enamel and glass substrates. For example, a glass having a composition of $Al_2O_3$-$B_2O_3$-$SiO_2$-$NaO_2$-$KO_2$ melts below 500° C. In this instance, the metal to aluminum ratio is adjusted to reduce the amount of heat generated to prevent melting of the substrate.

The exothermic reaction occurs at several stages in the process. According to U.S. application Ser. No. 07/775,127, thermally reactive powders of high purity are prepared by causing powders of aluminum and a second metal to collide at high velocities, thereby coating the softer aluminum metal onto the metal core. During the formation of the thermally reactive powder in this manner, a small amount of intermetallic compound may be formed with the resultant release of a small amount of heat $Q_1>O$. An exothermic reaction is then initiated in the plasma torch flame, with the concomitant release of heat $Q_2$. An amount of heat $Q_3$ is released as the reaction proceeds on the substrate surface. The heat $Q_3$ generated during the reaction promotes the diffusion of the coating into the substrate and forms a strong adhesive bond between the coating and the substrate. Total heat generated $Q_T$ is the sum of the individual steps, i.e., $Q_T=Q_1+Q_2+Q_3$. In order for an optimal adhesive coating to be obtained, it is desirable that the value of $Q_2$ be minimized and that of $Q_3$ be maximized.

Figure 2:
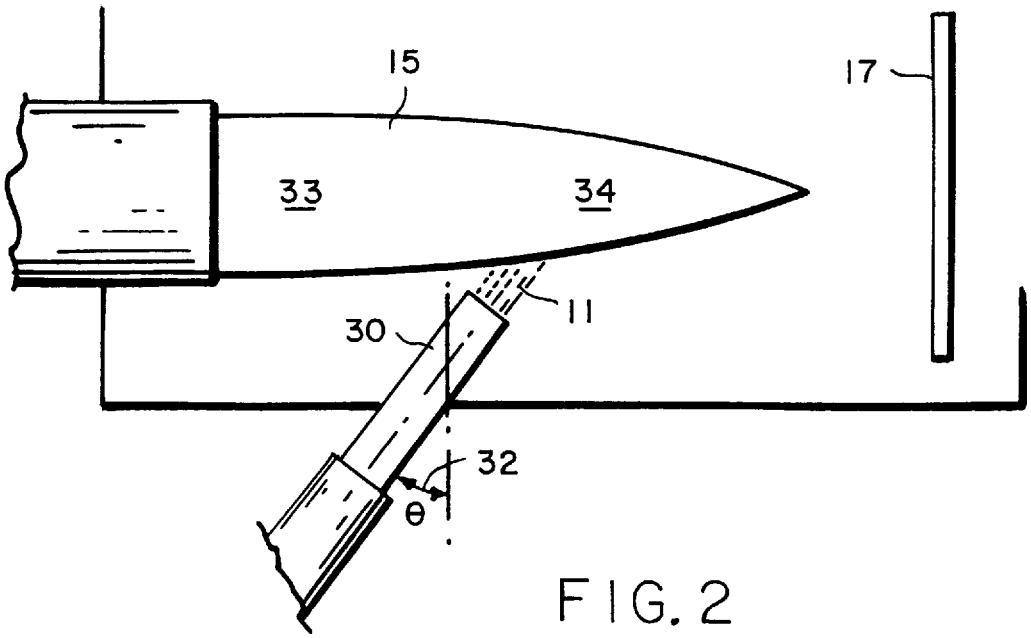
FIG. 2 shows a cross-sectional view of an apparatus illustrating another embodiment of the invention used to deposit the adhesive layer.

$Q_3$ can be maximized by adjusting the position of the substrate and entry point of the thermally reactive powders such that the time-of-flight of the exotherming powders is minimized or by reducing the dwell time of the powders in the flame. Preferably the substrate is positioned a distance in the range of 50 to 120 mm, and preferably 50 to 70 mm, from the base of the plasma flame. Further, $Q_2$ may be minimized by introducing thermally reactive powders into a cool zone of the plasma flame so that the exothermic reaction is initiated more slowly and proceeds to a lesser extent before being deposited on the substrate. It is recognized that the core of the plasma flame near the point of entry of the plasma gases has a higher temperature than the tip of the plasma flame. FIG. 2 illustrates an alternate method of introducing the thermally reactive powders 11 into the plasma torch flame 15. A powder feed tube 30 is positioned above or below the flame at an angle Θ (32 in FIG. 2). It has been determined experimentally that introducing the thermally reactive powders at an angle of 10°–15° (32 of FIG. 1) improves the adhesive properties of the resultant film. Powders can be introduced into a hot zone 33 near the base of the flame or a cool zone 34 near the tip of the flame.

It may be desirable for unreacted metal to remain in the intermetallic matrix. This imparts ductility and strength to the adhesive layer. The composition of the starting thermally reactive powder can be adjusted so as to afford unreacted metal in the coating.

The following examples are illustrative of the method and advantages of the present invention.

EXAMPLE 1

An adhesive layer was prepared on a thin substrate (50 μm) of steel alloy with a composition of 15% Cr and 5% Al using aluminum-clad nickel powders containing 20 wt % nickel and 80 wt % aluminum. The substrate was positioned a distance 60 mm from the tip of the plasma torch. The thermally reactive powders were introduced into the plasma torch at a distance of 40 mm from the base of the plasma flame torch. The adhesive layer was deposited in an inert atmosphere using a high velocity argon plasma torch with a plasma escape rate of 800±50 m/s. The final thickness of the adhesive layer was greater than 20 μm. The phase composition of the layer was determined by X-ray diffraction analysis and is reported in Table 1. X-Ray diffraction analysis indicated the presence of Ni-Al alloy and intermetallic compound $NiAl_3$, as well as unreacted nickel and aluminum metal (see sample #4, Table 1).

When similar reactions were carried out in air, $Al_2O_3$ was additionally observed by X-ray diffraction analysis.

EXAMPLE 2

A study was carried out to determine the effect of the substrate position on the characteristics of the deposited coating.

An adhesive coating was prepared as described above in Example 1. The substrate was positioned a distance of 60 mm, 100 mm and 120 mm from the base of the plasma torch flame. The substrate was water cooled to quench the reaction and fix the phase composition at the moment of particle impact with the substrate. In Sample #4, the layer was deposited without cooling. Results of compositional analysis by X-ray diffraction are reported in Table 1. In Sample #1, quenching of the exotherming powders on the substrate at a distance of 120 mm from the torch flame base indicated >90% conversion to intermetallic compounds NiAl and $NiAl_3$. However, the extent of conversion to the intermetallic compounds decreased significantly as the substrate was moved closer to the flame (see samples #2 and #3). Example #4 shows the phase composition of a layer deposited without quenching. The amount of intermetallic compounds comprising the layer has increased from ca. 25 wt % in a quenched sample to ca. 90 wt % in the unqueched sample. The difference indicates the amount of exotherm occurring at the substrate and is at a maximum for a position of 60 mm.

TABLE 1

Effect of substrate position on adhesive coating composition.

| sample | distance[1] (mm) | phase composition (wt %) Al | Ni | NiAl | $NiAl_3$ | substrate |
|---|---|---|---|---|---|---|
| 1 | 120 | 3 | 5 | 60 | 32 | cooled |
| 2 | 100 | 10 | 14 | 55 | 21 | cooled |
| 3 | 60 | 43 | 30 | 12 | 15 | cooled |
| 4 | 60 | 2 | 5 | 45 | 48 | uncooled |

[1]distance from base of torch flame to substrate

EXAMPLE 3

A study was carried to determine the adhesive quality of the coating when applied according to the method of the invention and using conventional methods.

A coating was prepared on a steel alloy substrate 100 mm wide and 50 μm thick as described above for Example 1. The resultant adhesive coating was tested for adhesion using the bend test. The sample prepared according to the method of the present invention survived bending to a diameter of less than 0.5 mm.

In comparison, aluminum-coated nickel powders were prepared by coating nickel with a fine dispersion of aluminum in binder. Finely divided aluminum powder was dispersed in an organic-based silicone adhesive. Such silicone adhesives are known to decompose under the high temperature conditions found in a plasma flame. Nickel particles were mixed with the aluminum mixture and the silicone adhesive was allowed to dry by slow evaporation of the solvent. A foil steel substrate was used which had been rigorously cleaned by an alkaline wash, then ultrasonic agitation and finally an ethanol wash. Care was taken to avoid. recontamination of the substrate.

These aluminum-coated nickel particles were subjected to plasma spraying under the conditions described in Example 1. The coating failed when bent around a cylinder having a diameter of 1–2 mm.

What is claimed is:

1. A method for preparing an adhesive layer on a substrate comprising the steps of:

introducing a thermally reactive powder comprising aluminum and a second metal into a plasma torch flame, wherein the thermally reactive powder is substantially free of binder, additive and contaminant and does not contain a significant amount of intermetallic compound;

initiating an exothermic reaction within the thermally reactive powders in the plasma torch flame; and impinging the exotherming powders onto a substrate, such that a substantial amount of the thermally reactive powder reaches the substrate unreacted, and the heat generated in the exothermic reaction is released predominantly at the substrate, thereby promoting diffusion of the powders into the substrate resulting in a strong adhesion of the adhesive layer to the substrate.

2. The method of claim 1 wherein the adhesion layer has a thickness in the range of 1 to 100 $\mu$m.

3. The method of claim 1 wherein the method is carried out under an inert atmosphere.

4. The method of claim 1 wherein the method is carried out in air.

5. The method of claim 1 wherein aluminum is mechanically coated to the second metal.

6. The method of claim 1 wherein the aluminum is chemically bonded to the second metal through an intermetallic interface layer.

7. The method of claim 1 wherein the thermally reactive powder is a mechanical alloy of aluminum and the second metal.

8. The method of claim 1 wherein the thermally reactive powder comprises a stoichiometric excess of aluminum.

9. The method of claim 1 wherein the composition of the thermally reactive powder is chosen so as to produce a desired amount of heat, $Q_3$, during the exothermic reaction on the substrate.

10. The method of claim 1 wherein the composition of the thermally reactive powder is chosen so as to produce a maximum of heat, $Q_3$, during the reaction on the substrate.

11. The method of claim 1 wherein the second metal is an alloy of two or more metals.

12. The method of claim 1 wherein the second metal is selected from the group of transition group metal and their alloys.

13. The method of claim 1 wherein the thermally reactive powder is selected from the group containing composite powders prepared from aluminum and one or more of Co, Cr, Mo, Ta, Nb, Ti or Ni.

14. The method of claim 1 wherein the second metal is nickel.

15. The method of claim 1 wherein the substrate is selected from the group consisting of metal, porous ceramic and glazed ceramic.

16. The method of claim 1 wherein the substrate is positioned relative to the plasma torch flame so as to minimize the time of flight of the exotherming powders.

17. The method of claim 16 wherein the substrate is positioned in the range of 50 to 70 mm from a base of the plasma torch flame.

18. The method of claim 16 wherein the substrate is positioned in the range of 50 to 120 mm from a base of the plasma torch flame.

19. The method of claim 1 wherein the thermally reactive powder is introduced into a hot zone of the plasma torch.

20. The method of claim 1 wherein the thermally reactive powder is introduced into a cool zone of the plasma torch.

21. The method of claim 1 wherein the thermally reactive powder is introduced into the plasma torch flame at an angle $\Theta$.

22. The method of claim 21 wherein the angle $\Theta$ is in the range of 10° to 15°.

23. The method of claim 1 wherein introduction of the thermally reactive powders is accomplished using a variably positionable feeder.

24. A method for preparing an adhesive layer on a substrate comprising the steps of:

introducing a thermally reactive powder comprising aluminum and a second metal into a plasma torch flame, wherein the thermally reactive powder is substantially free of binder, additive and contaminant and does not contain a significant amount of intermetallic compound;

initiating an exothermic reaction within the thermally reactive powders in the plasma torch flame; and impinging the exotherming powders onto a substrate which is positioned at a distance from the plasma torch flame, such that the heat generated in the exothermic reaction is released predominantly at the substrate, thereby promoting diffusion of the powders into the substrate resulting in a strong adhesion of the adhesive layer to the substrate.

25. A method in accordance with claim 24, wherein the substrate is positioned in the range of 50 to 120 mm from the base of the plasma torch flame.

26. A method in accordance with claim 24, wherein the substrate is positioned in the range of 50 to 70 mm from the base of the plasma torch flame.

27. A method for preparing an adhesive layer on a substrate comprising the steps of:

selecting an angle of powder introduction of less than 90° with respect to the plasma torch flame to minimize the time of flight of the thermally reactive powders;

introducing a thermally reactive powder comprising aluminum and a second metal into the plasma torch flame, wherein the thermally reactive powder is substantially free of binder, additive and contaminant and does not contain a significant amount of intermetallic compound;

initiating an exothermic reaction within the thermally reactive powders in the plasma torch flame; and impinging the exotherming powders onto a substrate, such that the heat generated in the exothermic reaction is released predominantly at the substrate, thereby promoting diffusion of the powders into the substrate resulting in a strong adhesion of the adhesive layer to the substrate.

28. A method in accordance with claim 27, wherein the angle of powder introduction from the feeder is 10°–15° with respect to the plasma torch flame.

* * * * *